US008037629B2

(12) United States Patent
Harris

(10) Patent No.: US 8,037,629 B2
(45) Date of Patent: Oct. 18, 2011

(54) DISPLAY PANEL MOUNTING SYSTEM AND METHOD

(75) Inventor: Rod Harris, McLean, VA (US)

(73) Assignee: Truck Ads, LLC, McLean, VA (US)

( * ) Notice: Subject to any disclaimer, the term of this patent is extended or adjusted under 35 U.S.C. 154(b) by 144 days.

(21) Appl. No.: 11/798,208

(22) Filed: May 11, 2007

(65) Prior Publication Data

US 2008/0276510 A1 Nov. 13, 2008

(51) Int. Cl.
*G09F 7/12* (2006.01)
*G09F 21/04* (2006.01)

(52) U.S. Cl. ..... 40/594; 40/590

(58) Field of Classification Search ..... None
See application file for complete search history.

(56) References Cited

U.S. PATENT DOCUMENTS 3,372,503 A * 3/1968 Weeks ..... 40/600
3,897,645 A * 8/1975 Scheyer ..... 40/800
4,568,589 A * 2/1986 Briggs ..... 428/63
5,691,027 A * 11/1997 Eckhardt et al. ..... 428/100
5,700,537 A * 12/1997 Instance ..... 428/41.9
6,286,238 B1 * 9/2001 Harrington ..... 40/202
6,393,746 B1 5/2002 Jacobson
6,460,280 B1 * 10/2002 Haines-Woon ..... 40/768
6,904,709 B2 6/2005 Craig et al.
2001/0008687 A1 * 7/2001 Kollaja et al. ..... 428/220
2004/0231208 A1 11/2004 Pitt
2006/0070282 A1 4/2006 Craig et al.
2006/0207141 A1 9/2006 Pitt et al.

OTHER PUBLICATIONS

Federal Highway Administration, Dot, p. 279-280, Section 658.15.
TruckAds Frame Installation Manual, pp. 1-10, Dec. 21, 2006.

* cited by examiner

*Primary Examiner* — Joanne Silbermann
(74) *Attorney, Agent, or Firm* — Bacon & Thomas, PLLC

(57) ABSTRACT

A display mounting kit, system, and method are disclosed utilizing first and second primary releasable attachment elements that are secured about the periphery of a display panel and in a substantially corresponding relationship on a mounting surface, respectively. At least one supplementary fastening element having a stiff core and first and second substantially planar surfaces for respective engagement with the display panel and the mounting surface provides secure mounting between the display panel and the mounting surface.

8 Claims, 6 Drawing Sheets

DISPLAY PANEL MOUNTING SYSTEM AND METHOD

FIELD OF THE INVENTION

The present invention relates generally to the field of display panels, and more particularly to a display panel mounting system and method.

BACKGROUND

In the present commercially competitive environment, product placement and awareness have become paramount to success in any given field. To promote product awareness, many companies have utilized banner ads on the Internet. While Internet advertising has certainly increased in the past decade and a half, print advertising in the form of banner ads and billboards remains a staple of many advertising campaigns.

One frequently untapped or overlooked asset for banner ad space is the vertical sides of load-carrying or passenger freight vehicles. Currently, many of these vehicles have substantially vertical sides that are unadorned, or carry minimal information, such as small company logos. These vehicle sides are extensively exposed to the sight of the general public since these vehicles travel across the country and through urban and suburban centers where the general public is also utilizing the same roads for their own purposes. In urban and suburban centers, pedestrians are also exposed to the numerous vehicles that pass through on city streets.

While there are a few existing systems that are designed to transform the side of a vehicle into advertising space, these existing systems have numerous drawbacks. Many of the existing systems require complicated structural frames that are mounted to the exterior of the vehicle. Such frames tend to be bulky and to have considerable weight. Typically, extensive modification to the vehicle is required prior to the use of such a frame. For example, numerous rails, mounting brackets, and mechanical fasteners are required in order to mount a banner ad display panel to the side of a vehicle.

An alternative mounting system that does not require the addition of a bulky and complicated structural frame to the exterior of a vehicle is disclosed in U.S. Pat. No. 6,904,709, granted Jun. 14, 2005, and herein incorporated by reference. The mounting system includes corresponding reclosable fasteners mounted to the vehicle sidewall and around the perimeter of the display panel. While this system is an improvement over the previous structural frame systems, it does not provide the same level of security as the structural frame systems. Due to the reclosable nature of the fasteners, there is the possibility that the fasteners will untimely separate under external forces such as wind and vehicle vibrations.

Accordingly, a supplementary fastening system to increase the security of the mounting system of the '709 patent may be provided in order to prevent the banner or display panel from flying off of a moving vehicle, or from being torn off of a mounting surface due to high wind. An example of such a supplementary fastening system is described in U.S. publication no. 2006/0070282, published Apr. 6, 2006, and herein incorporated by reference.

The supplementary fastening system of the '282 publication includes a fastening device composed of two parts. The first part has a surface that is attached to the sidewall of a vehicle. A protruding stem extends from an opposing surface of the first part. The stem protrudes through an aperture in the display panel and is received within a retaining member. The retaining member has flared edges that extend beyond the aperture in the display panel in order to engage the surface of the display panel.

There are a number of problems associated with the structure of the supplementary fastening device of the '282 publication. One of the problems relates to the fact that the protruding stem of the first part extends away from the vehicle sidewall. U.S. federal regulations promulgated by the U.S. Department of Transportation place a maximum width for vehicles traveling on the national network of interstate highways to be 102.36 inches or less (23 C.F.R §658.15). Most modern box trailers and trucks are built to be 102 inches in width in order to maximize the amount of cargo capacity while staying within the legal width proscribed by the government. When the supplementary fastening device of the '282 publication is placed on both sides of trailers and vehicles that are designed to be 102 inches in order to fit just within the federal standards, the width of the vehicle or trailer increases to greater than the 102.36 inches allowed by law. Thus, use of the supplementary fastening device of the '282 publication may be illegal in some situations.

Further, due to the flared edges of the retaining member, the supplementary fastening device of the '282 publication has a tendency to damage display panels. With the standard vinyl and other plastic display panels, the flared edges of the retaining member actually cut through the display panel, thus rendering the supplementary fastening device of the '282 publication ineffective.

Thus, an improved display panel mounting system, kit, and method are disclosed herein that overcome these and other disadvantages of the prior display panel mounting systems, as will be more fully recognized in view of the following disclosure and appended drawing Figures.

SUMMARY

In accordance with the foregoing discussion, an improved display mounting system, kit, and method are described, wherein the disadvantages of previous display mounting systems are avoided.

In one embodiment of the present disclosure, a display panel mounting system includes a first primary releasable attachment element for placement in a first pattern about a periphery of the display panel. A second primary releasable attachment element is provided for placement on a mounting surface. The second primary releasable attachment element is provided in a second pattern, which substantially corresponds to the first pattern. The second primary releasable attachment element is selectively engageable with the first primary releasable attachment element to define a frame for mounting a display panel to a mounting surface. At least one supplementary fastening element having a stiff core is provided. The at least one supplementary fastening element has first and second substantially planar surfaces for respective engagement with the display panel and the mounting surface and acts as a spacer and provides secure supplementary mounting between a display panel and a mounting surface. The at least one supplementary fastening element may have a thickness between the first and second surfaces in the range of about 1/16 to 3/8 of an inch. In one variation, a plurality of supplementary fastening elements is provided for placement about the periphery of the display panel adjacent to the first and second primary releasable attachment elements.

In order to secure the at least one supplementary fastening element to both the display panel and the mounting surface, adhesive is provided on each of the first and second surfaces.

In a variation, the adhesive is a double-sided tape adhesive. In a further variation, the adhesive is a very high bond adhesive.

In order to perform the selective engagement between the first and second primary releasable attachment elements, the first and second primary releasable attachment elements are lengths of a substrate that includes a plurality of periodically spaced interlocking posts, wherein the first and second primary releasable attachment elements are selectively and releasably interlocked with each other to define a frame to mount a display panel to a mounting surface.

In another embodiment of the present disclosure, a display panel mounting kit includes a first primary releasable attachment element arranged for placement in a first pattern about a periphery of the display panel. A second primary releasable attachment element is arranged for placement in a second pattern, substantially corresponding to the first pattern, on a mounting surface. The second primary releasable attachment element is configured for selective engagement with the first primary releasable attachment element to define a frame for mounting a display panel to a mounting surface. At least one supplementary fastening element having a stiff core is provided. The at least one supplementary fastening element has first and second substantially planar surfaces arranged for respective engagement with the display panel and the mounting surface and acts as a spacer and provides secure supplemental mounting between a display panel and a mounting surface. The at least one supplementary fastening element may have a thickness between the first and second surfaces in the range of about 1/16 to 3/8 of an inch.

In one variation, a plurality of supplementary fastening elements are provided for placement about the periphery of the display panel adjacent to the first and second primary releasable attachment elements. In another variation, a portion of the plurality of supplementary fastening elements are provided for placement about the periphery of the display panel adjacent to the first and second primary releasable attachment elements and the remaining portion of the plurality of supplementary fastening elements are provided for placement along a middle portion of the display panel.

In order to secure the at least one supplementary fastening element to both the display panel and the mounting surface, adhesive is provided on each of the first and second surfaces. In a variation, the adhesive is a double-sided tape adhesive. In a further variation, the adhesive is a very high bond adhesive.

In order to perform the selective engagement between the first and second primary releasable attachment elements, the first and second primary releasable attachment elements are lengths of a substrate that includes a plurality of periodically spaced interlocking posts, wherein the first and second primary releasable attachment elements are selectively and releasably interlocked with each other to define a frame to mount a display panel to a mounting surface. In a variation, the number of supplementary fastening elements is related to the size of the display panel.

In a further variation, the kit includes at least one packet of activating wipes for promoting adhesion between the first and second primary releasable attachment elements and the display panel and the mounting surface, respectively.

In another embodiment of the present disclosure, a method of mounting a display panel onto a substrate includes securing a first primary releasable attachment element in a first pattern about a periphery of a display panel. The method further includes securing a second primary releasable attachment element in a second pattern on a mounting surface, substantially corresponding to the first pattern. The method further includes securing a first substantially planar surface of at least one supplementary fastening element having a stiff core to the substrate. The method further includes engaging the first and second primary releasable attachment elements to form a frame for mounting a display panel to a substrate. Lastly, the method includes securing a second substantially planar surface of the at least one supplementary fastening element to the display panel, wherein the at least one supplementary fastening element acts as a spacer element and provides secure supplemental mounting between a substrate and a display panel.

In a variation, the method includes securing a plurality of supplementary fastening elements having first and second substantially planar surfaces to the substrate and the display panel, respectively. In a variation, the method includes securing the plurality of supplementary fastening elements about the periphery of the display panel, adjacent to the first and second primary releasable attachment elements. In a further variation, a portion of the plurality of supplementary fastening elements are secured about the periphery of the display panel and the remaining portion are secured along a middle portion of the display panel.

The numerous advantages, features and functions of the various embodiments of the display mounting system, kit, and method will become readily apparent and better understood in view of the following description, appended claims, and accompanying drawings. The following description is not intended to limit the scope of the display mounting system, kit, and method, but instead merely provides exemplary embodiments for ease of understanding.

Figure 1:
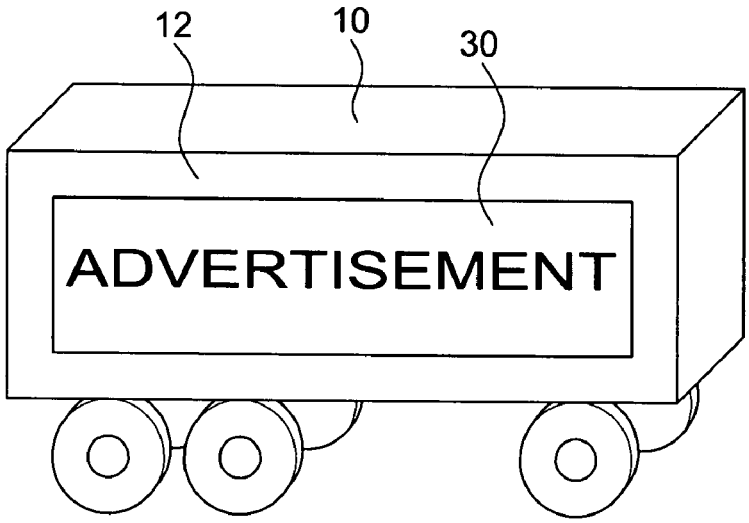
FIG. 1 is a perspective view of a display panel mounted on a vehicle or trailer in accordance with an embodiment of the present disclosure.

In the various figures, similar elements are identified with the same reference numbers. It should be noted that the drawing figures are not necessarily drawn to scale, but instead are drawn to provide a better understanding of the components thereof, and are not intended to be limiting in scope, but rather provide exemplary illustrations.

DETAILED DESCRIPTION OF VARIOUS EMBODIMENTS

As shown in FIG. 1, a display panel 30 is mounted to the exterior of a vehicle or vehicle trailer 10. The vertical sidewall of the vehicle acts as the mounting surface 12. It will be recognized that other mounting surfaces, such as walls and billboards, may be used, as will be discussed further below.

The display panel 30 is a substantially non-permeable flexible sheet. Any suitable sheet may be provided that is capable of receiving and retaining a printed face or other indicia. An exemplary display panel 30 is formed as a vinyl sheet. Of course any suitable material may be used, such as PES (polyethersulfone) fabric coated on both sides with PVC (polyvinylchloride) and having a matt lacquer applied to the printed side. Further, a semi-permeable flexible sheet may also be used. It will also be recognized that a display panel formed of wood, metal, or any other material that graphics may be printed upon, may be utilized. Specifically, the discussion below is not limited to flexible materials, but also encompasses semi-rigid and rigid materials.

Figure 2:
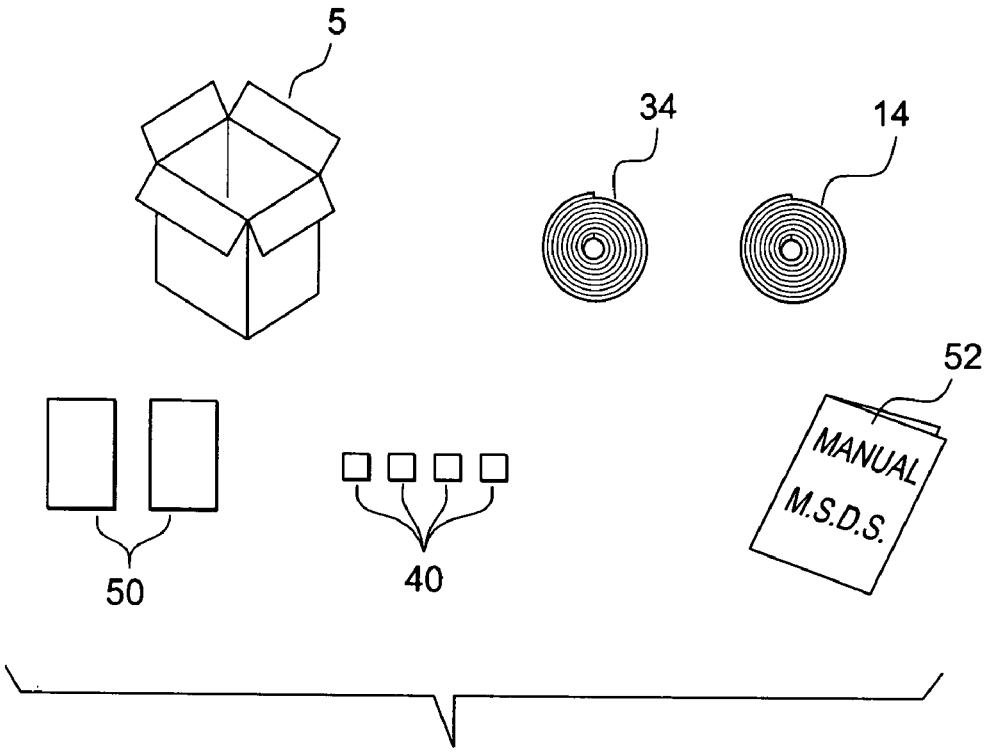
FIG. 2 is an exploded view of a kit for mounting a display panel according to an embodiment of the present disclosure.

A kit 1, as seen in FIG. 2, is provided for mounting the display panel 30 to a surface or substrate. The kit 1 includes a container 5, such as a cardboard or plastic box, for receiving the components of the kit 1 therein. The components include first 34 and second 14 primary releasable attachment elements, which together form the main frame for mounting the display panel 30 to a substrate. The kit 1 further includes at least one packet of activating wipes 50 and the manual and MSDS 52 (Material Safety and Data Sheet) for the kit 1. The packet of activating wipes includes a wipe with 6 mL of activator, which promotes adhesion. Of course, the packet of activating wipes may include wipes with any amount of activator, such as any amount up to 10 mL. Packets having wipes containing greater than 10 mL may be used, however, additional safety and shipping requirements must be met. Thus, according to the exemplary embodiment, the kit 1 may be easily sent through regular mail channels without requiring indicia that the container 5 includes hazardous materials therein.

Also included in the kit is at least one supplementary fastening element 40 having a stiff, rigid, semi-rigid, or flexible core and that acts as a spacer element. The supplementary fastening element 40 forms part of a securing element that provides secure supplementary mounting between a display panel and a mounting surface in addition to the first and second primary releasable attachment elements. Since the first and second primary releasable attachment elements are selectively engageable with each other, there is the possibility that they may become disengaged at inappropriate times, such as when a vehicle is traveling on the highway. Thus, the supplementary fastening element 40 provides a secure supplementary mounting between a display panel and a mounting surface in addition to the first and second primary releasable attachment elements to prevent inadvertent disengagement of the first and second primary releasable attachment elements.

The supplementary fastening element 40 may be formed from any suitable material, such as ABS, PVC, metals, plastics, carbon fiber epoxy composites, or glass fiber epoxy composites. The supplementary fastening element 40 may be a stiff material, such as a material that is resistant to bending. While the supplementary fastening element 40 is shown having a square shape, it will be recognized that any suitable shape may be used, such as circular, oval, rectangular, parallelepiped, or any n-sided shape, where n is an integer.

Figure 7:
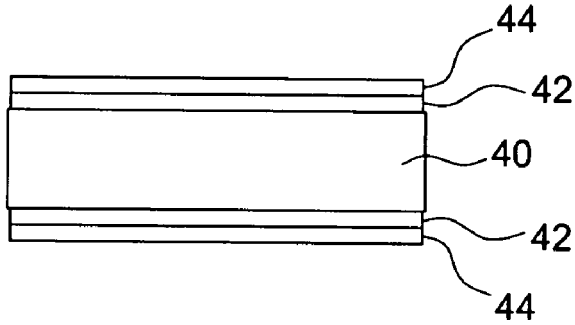
FIG. 7 is a side view of a supplementary fastening element in accordance with the present disclosure.

As shown in FIG. 7, the supplementary fastening element has first and second substantially planar surfaces. The surfaces are for the most part planar, while allowing for minor out of plane deviations due to manufacturing and processing limitations. These surfaces define the contact areas for respective attachment to the display panel and the mounting surface in a manner to be discussed below. It will be recognized that the surface areas of the supplementary fastening element may be any suitable size, for example approximately 1 and ½ inches by 1 and ½ inches, or 2 and ¼ inches square. Of course any larger or smaller area may be utilized within the scope of this disclosure.

In order to secure the supplementary fastening element 40 to the mounting surface 12 and the display panel 30, an adhesive is provided on each of the first and second substantially planar surfaces of the supplementary fastening element 40. The adhesive may be a double-sided tape 42 having a protective sheet 44 thereon in order to avoid inadvertent securement of the supplementary fastening element 40 to any surface. The protective sheet 44 is simply removed when a user wishes to secure the supplementary fastening element 40 to the mounting surface 12 and the display panel 30. An exemplary double-sided tape may be VHB™ Tape which does not degrade or erode the vinyl of the display panel 30.

While the double sided tape 42 is shown on both of the first and second substantially planar surfaces of the supplementary fastening element, any other suitable attachment mechanism may be utilized. Further, different attachment mechanisms may be utilized for each surface. For example, a mechanical fastener, such as a screw or bolt, may be used to secure the supplementary fastening element 40 to the mounting surface 12 and the double-sided tape 42 may be used to secure the supplementary fastening element 40 to the display panel 30. Other suitable attachment mechanisms include, but are not limited to, welding, bonding, and sewing.

As mentioned above, first and second primary releasable attachment elements 34, 14 are included in the kit 1. As shown, the first and second primary releasable attachment elements 34, 14 are lengths of material that are rolled up in order to reduce the amount of space that they occupy in the container 5. Of course, the first and second primary releasable attachment elements 34, 14 are not required to be in a rolled up configuration. The kit 1 may include appropriately predetermined lengths of both the first and second primary releasable attachment elements 34, 14, depending upon the size of the display panel to be mounted. A plurality of supplementary fastening elements 40 may be provided in the kit 1, in correspondence with the size of a display panel.

For example, when the system is used for mounting a display panel to a vehicle that will be traveling at highway speeds, the following exemplary numbers and positions of supplementary fastening elements 40 may be utilized. For display panels that are between 5 and 10 feet in width, two supplementary fastening elements 40 may be positioned along the top at each corner. For display panels that are between 12 and 20 feet in width, two supplementary fastening elements 40 may be positioned along the top at each corner, along with a third supplementary fastening element 40 equally spaced therebetween. For display panels that are between 12 and 36 feet in width, two supplementary fastening elements 40 may be positioned along the top at each corner, along with a third and fourth supplementary fastening element 40 equally spaced therebetween. For display panels that are between 40 and 53 feet in width, two supplementary fastening elements 40 may be positioned along the top at each corner, along with a third, fourth, and fifth supplementary fastening element 40 equally spaced therebetween.

For display panels that are between 2 and 5 feet in height, two supplementary fastening elements 40 may be positioned along the front at each corner. For display panels that are between 6 and 10 feet in height, two supplementary fastening elements 40 may be positioned along the front at each corner, along with a third and fourth supplementary fastening element 40 equally spaced therebetween. For display panels that are between 2 and 10 feet in height, two supplementary fastening elements 40 may be positioned along the rear at each corner.

Exemplary numbers and positions of supplementary fastening elements 40 may be utilized for mounting display panels to walls and other stationary mounting surfaces as follows. For display panels that are between 3 and 14 feet in length or height, four supplementary fastening elements 40 may be positioned at each corner. For display panels that are between 16 and 22 feet in length or height, four supplementary fastening elements 40 may be positioned at each corner, along with an additional supplementary fastening element 40 equally spaced along each side between the corners. For display panels that are between 24 and 36 feet in length or height, four supplementary fastening elements 40 may be positioned at each corner, along with two additional supplementary fastening elements 40 equally spaced along each side between the corners. For display panels that are between 40 and 53 feet in length or height, four supplementary fastening elements 40 may be positioned at each corner, along with three additional supplementary fastening elements 40 equally spaced along each side between the corners.

Of course, the above mentioned numbers and positions of the supplementary fastening elements 40 are merely exemplary, and any other suitable configuration and number of supplementary fastening elements 40 may be utilized as appropriate.

Figure 9:
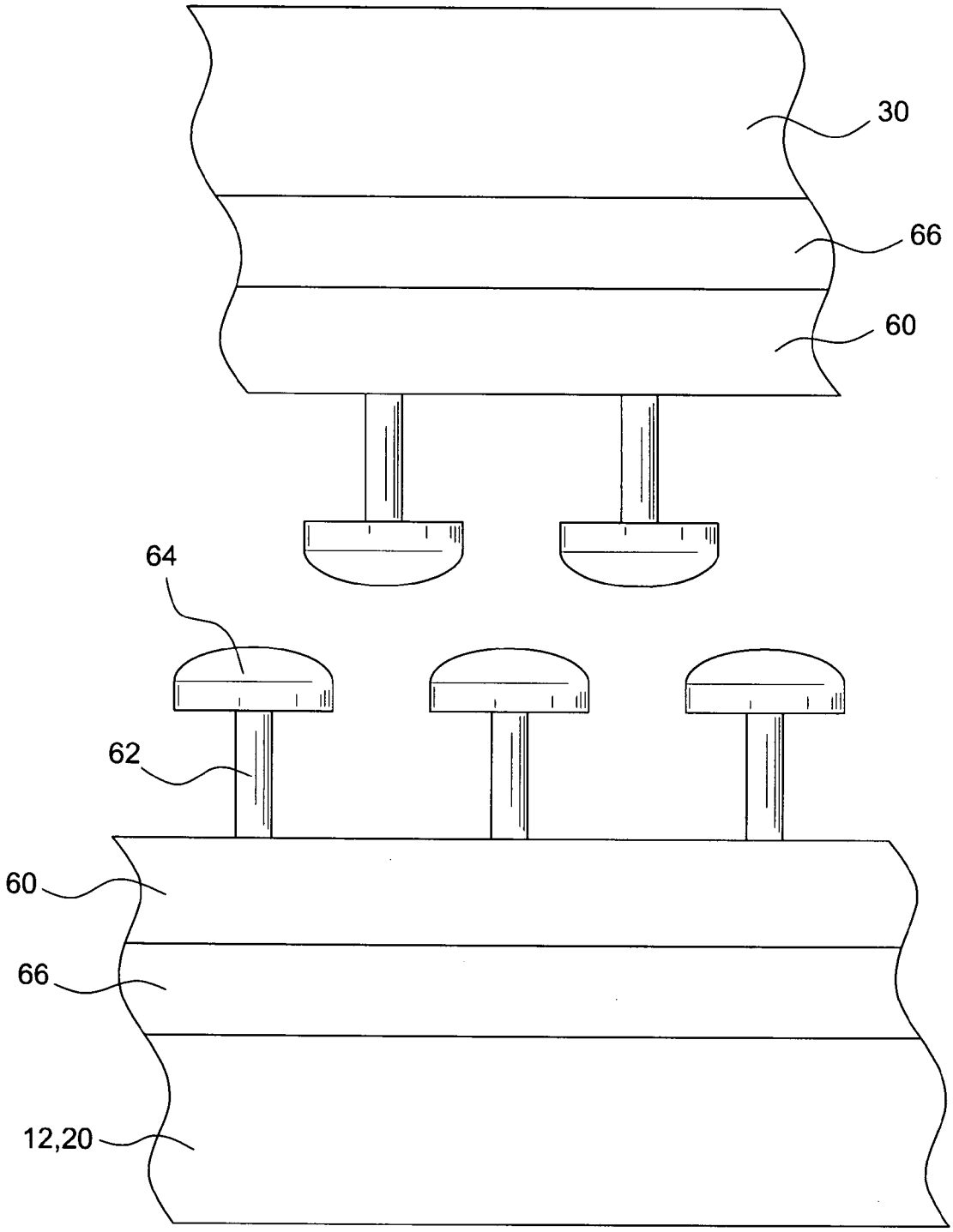
FIG. 9 is a partial side view of the first and second primary releasable attachment elements prior to engagement in accordance with the present disclosure.
Figure 10:
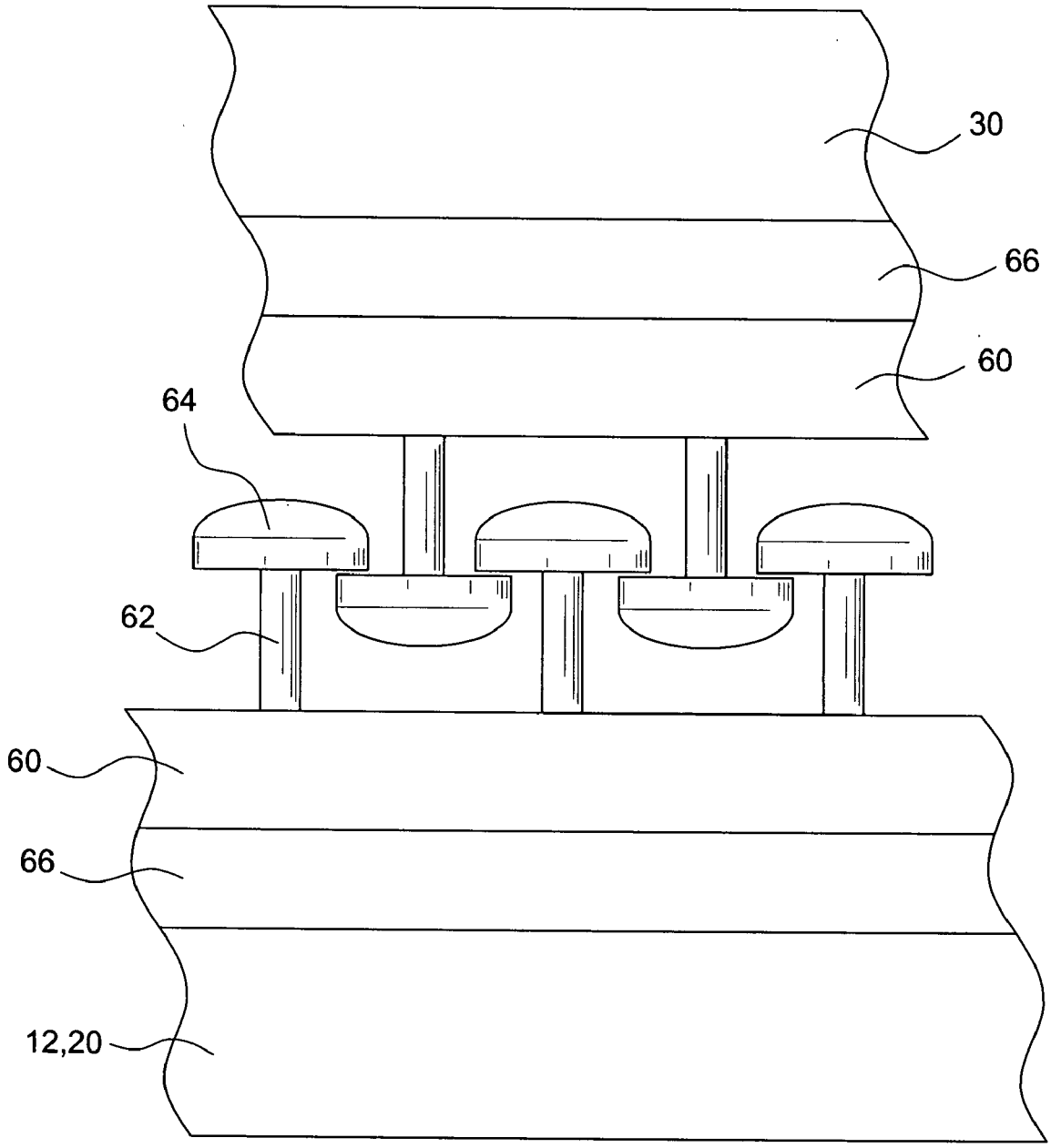
FIG. 10 is a partial side view of the first and second primary releasable attachment elements after engagement in accordance with the present disclosure.

The first and second primary releasable attachment elements 34, 14 may be lengths of Dual Lock™, which may also include a matching length of double-sided adhesive tape 66, as shown in FIGS. 9 and 10, similar to the tape 42. Other adhesives, such as acrylic or pressure sensitive adhesives may also be used. Of course, any suitable primary releasable attachment element may be utilized, such as any form of hook and loop fastener, or any suitable mechanical fastener. With the use of Dual Lock™ for the first and second primary releasable attachment elements 34, 14, a piece of wax paper may be included in the kit 1 between stacked rolls of the first and second primary releasable attachment elements 34, 14 in order to prevent adhesion between the first and second primary releasable attachment elements 34, 14.

Figure 8:
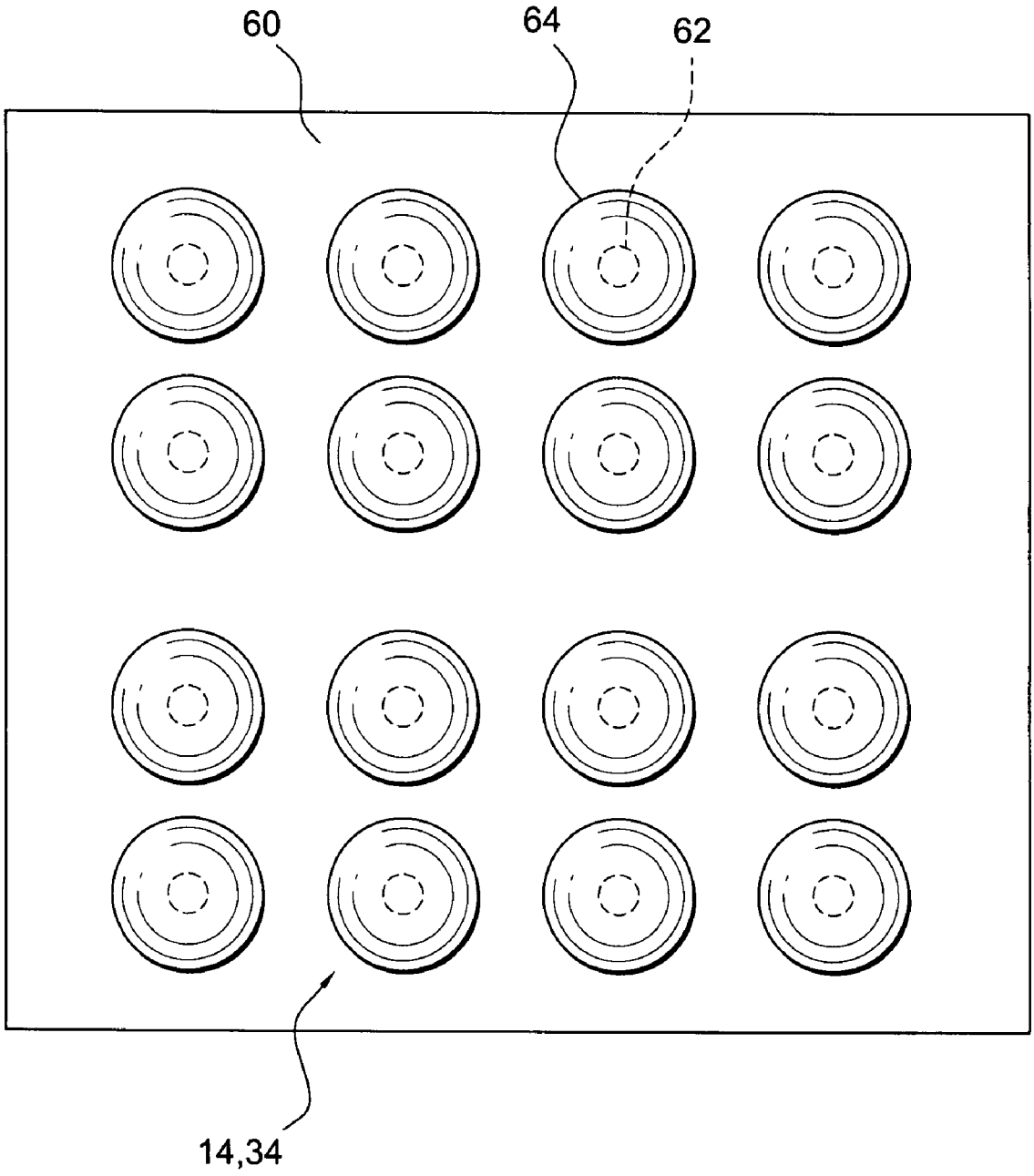
FIG. 8 is a schematic plan view of a primary releasable attachment element in accordance with the present disclosure.

As can be seen in FIGS. 8-10, each of the first and second primary releasable attachment elements includes a substrate 60 which carries a plurality of periodically spaced posts 62. Each post 62 includes a head 64, such that when two substrates 60 are brought into contact with each other, the posts 62 and heads 64 interlock in order to engage the two substrates together, as can be seen best in FIG. 10.

Figure 3:
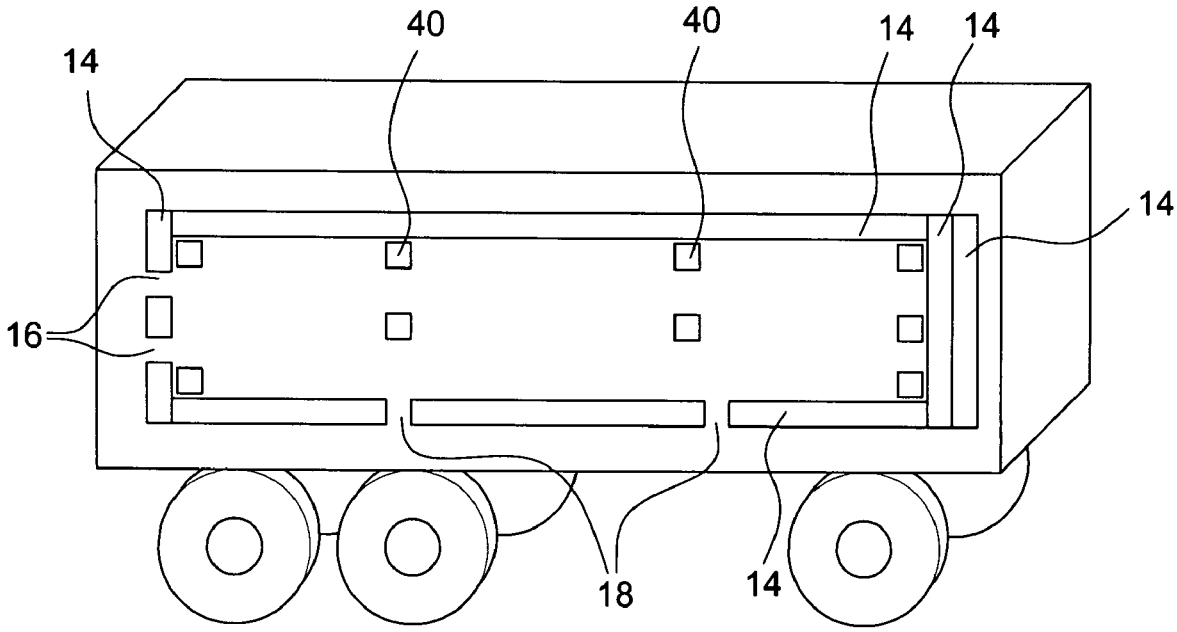
FIG. 3 is a perspective view of a primary releasable attachment element secured in an exemplary pattern to a vehicle or trailer in accordance with the present disclosure.

The method of using the display panel mounting system is now described in reference to FIGS. 3-6. As shown in FIG. 3, a vehicle 10 includes sidewalls that define a mounting surface 12. Prior to mounting the display panel 30 onto the mounting surface 12, the surface is cleaned with an appropriate solvent, such as Isopropyl alcohol mixed with 50% water. The surface may then be slightly abraded using any suitable tool, such as an abrasive pad.

The length of the second primary releasable attachment element 14 is appropriately cut and trimmed in order to match the outline of the display panel 30. The surface 12 is treated with the activator wipes in order to aid the curing or bonding of the second primary releasable attachment element 14 to the surface 12. As shown in FIG. 3, the second primary releasable attachment element 14 is secured to the surface 12 in an exemplary pattern or outline that substantially matches the outline of the periphery of the display panel 30. While the pattern shown in FIG. 3 is formed by segmented strips and includes gaps, it will be understood that the word "pattern" refers to a general outline or configuration, and thus the pattern may be formed by continuous or segmented portions, or any other suitable arrangement of the primary releasable attachments.

As also shown in FIG. 3, two strips of the second primary releasable attachment element 14 are arranged in parallel adjacent to each other towards the front of the trailer or vehicle. This element provides additional support to the frame in order to counteract the effect of wind resistance on the frame and display panel 30 while the vehicle is in motion. As an additional precaution, the layout or pattern of the second primary releasable attachment element 14 alternates with the layout or pattern of the first primary releasable attachment element 34, as will be discussed in more detail below.

Further, gaps 16 may be provided in the section of the second primary releasable attachment element 14 that is towards the rear of the vehicle in order to allow any air that is trapped between the surface 12 and the display panel 30 to escape. Thus, billowing of the display panel 30 is avoided. Drainage gaps 18 may be positioned along the section of the second primary releasable attachment element 14 that is along the lower portion of the vehicle in order to allow any moisture or condensation that is trapped between the surface 12 and the display panel 30 to escape.

Figure 4:
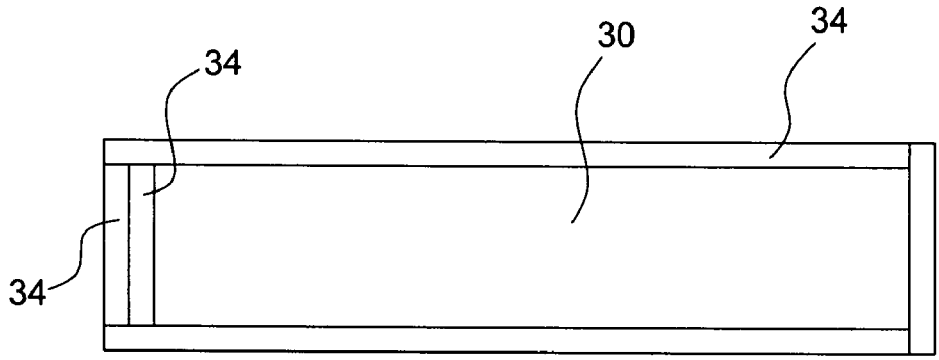
FIG. 4 is a side view of a primary releasable attachment element secured in an exemplary pattern to a display panel in accordance with the present disclosure.

As can be seen in FIG. 4, the first primary releasable attachment element 34 is secured in an exemplary pattern about the periphery of the display panel 30 in a corresponding manner to the second primary releasable attachment element 14. In order to provide additional support and structure for a vinyl banner type display panel 30, no gaps are provided in the first primary releasable attachment element 34 about the periphery of the display panel 30. However, gaps may be provided if desired, or if display panels that are rigid or semi-rigid and that can sufficiently support themselves are utilized. For example, gaps may be provided in sections of the first primary releasable attachment element 34 that correspond to the same sections in the second primary releasable attachment element 14, thus completing the air and moisture passageways.

The surface of the display panel 30 may also be cleaned and/or treated with the activating wipes, in the same manner as discussed above, prior to securing the first primary releasable engagement 34 element to the display panel 30. It is understood that the first primary releasable attachment element 34 may be arranged in a pattern, as pattern is defined above with respect to the second primary releasable attachment element 14. In particular, the pattern of the first primary releasable engagement 34 may be formed in a continuous or segmented manner, or in any other suitable configuration.

Figure 5:
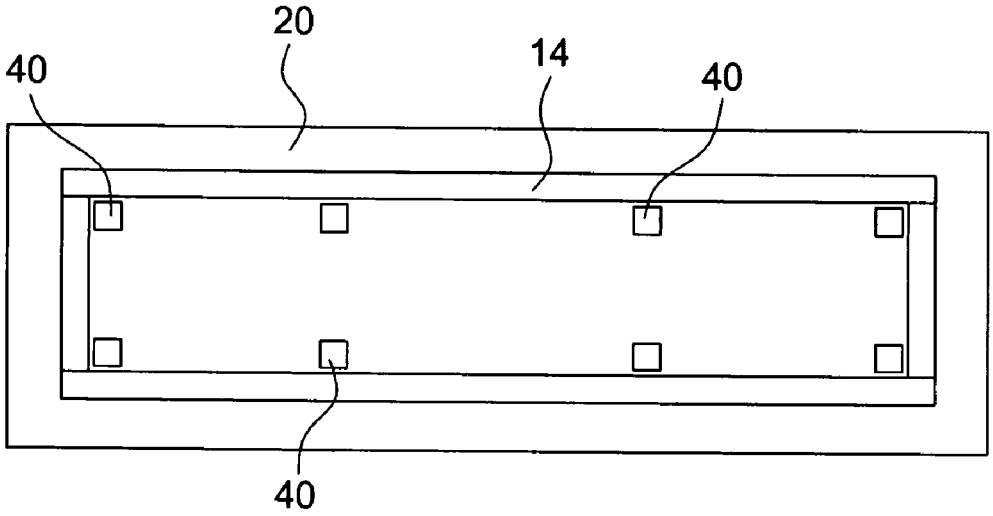
FIG. 5 is side view of a primary releasable attachment element secured in an exemplary pattern to a substrate, such as a wall or billboard, in accordance with the present disclosure.
Figure 6:
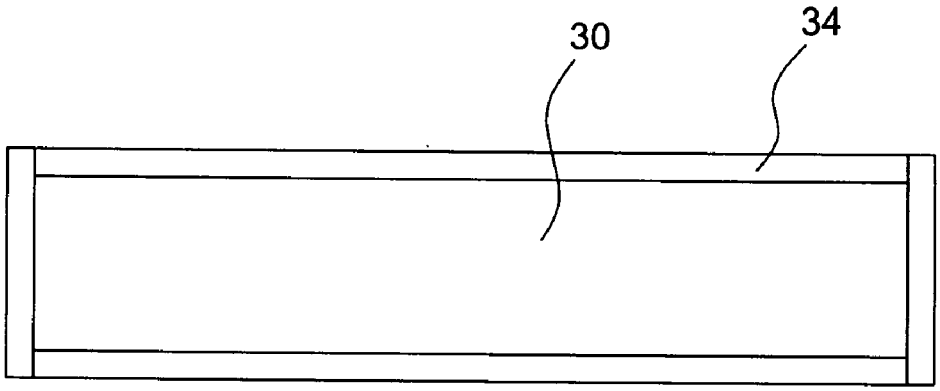
FIG. 6 is a side view of a primary releasable attachment element secured in an exemplary pattern to a display panel in accordance with the present disclosure.

As can also be seen in FIGS. 3 and 4, the sections of the first and second primary releasable attachment elements 34, 14 alternate between the mounting surface 12 and the display panel 30. Specifically, on the mounting surface 12, the forward and rear sections of the second primary releasable attachment element 14 extend and abut the ends of the upper and lower sections of the second primary releasable attachment element 14. In contrast, on the display panel 30, the upper and lower sections of the first primary releasable attachment element 34 extend and abut the ends of the forward and rear sections of the first primary releasable attachment element 34. This element forms an interlocking structure that aids in preventing the accidental removal of the display 30 from the mounting surface 12. Of course, any suitable alternating element may be used. As illustrated in FIGS. 5 and 6, the alternating element is modified to be the converse of that shown in FIGS. 3 and 4.

Prior to attaching the display panel 30 to the mounting surface 12, supplementary fastening elements 40 are secured to the mounting surface 12. The thickness of the supplementary fastening elements 40, and the associated double sided adhesive tape 42 for each side, is appropriately sized such that when the display panel 30 is mounted to the mounting surface 12, the supplementary fastening elements 40 engage the display panel 30 without extending beyond or through the surface of the display panel 30.

The supplemental fastening elements 40 may be mounted in any suitable arrangement within or about the patterns of the first and second primary releasable attachment elements 34, 14 in order to increase the safety and effectiveness of the display mounting system. Of course, as used herein, the word "within" applies to any configuration that literally is encompassed between the patterns of the first and second primary releasable attachment elements 34, 14, and any configuration that is adjacent or near to the first and second primary releasable attachment elements 34, 14, but that is not literally encompassed between the patterns of the first and second primary releasable attachment elements 34, 14.

For example, an appropriate number of fastening elements 40 may be mounted in equally spaced increments adjacent to the upper, front, and rear sections of the first and second primary releasable attachment elements 34, 14. Additional fastening elements 40 may be mounted along a middle portion of the display panel, as also shown in FIG. 3. The protective sheet 44 on the second side of the fastening element 40 is removed, and the adhesive tape 42 is secured to the mounting surface 12. This process is repeated for each supplemental fastening element 40.

Once all of the supplemental fastening elements 40 have been secured to the mounting surface, the protective sheets 44 on the first side of the fastening elements 40 may be removed and the first and second primary releasable attachment elements 34, 14 are brought into interlocking engagement with each other in order to mount the display panel 30 onto the mounting surface 12. Due to the thickness of the frame defined by the interlocked first and second primary releasable attachment elements 34, 14, a gap is formed between the display panel 30 and the mounting surface 12. The fastening elements 40 act as spacers within the gap to provide additional stability and support to the frame defined by the interlocked first and second primary releasable attachment elements 34, 14.

To complete the mounting of the display panel 30, the surface of the display panel facing the gap is secured to the first substantially planar surface of the fastening elements 40 in order to provide the additional securing mechanism of the display mounting system that does not increase the width of a trailer or vehicle beyond the 102.36 inches allowed by law.

The embodiment of FIGS. 5 and 6 also show an example of utilizing the display panel mounting system on any suitable substrate 20 such as a wall or billboard. The method of mounting the display panel 30 to the substrate 20 is the same in almost every respect as described above. However, due to the lack of wind resistance caused by motion of a vehicle, since walls and billboards are stationary objects, the two parallel strips of the first and second primary releasable attachment elements 34, 14, and the gaps 16, 18, 36, 38 are not necessary, although the drainage gaps 18, 38 may still be provided. Additionally, an alternative arrangement of the supplemental fastening elements 40 is shown in FIG. 5.

As previously discussed, any suitable number or arrangement of supplemental fastening elements 40 may be used. For example, a single large supplemental fastening element 40 may be provided centered in the middle portion of the display panel 30.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various features from different embodiments. In addition to the variations described herein, other known equivalents for each feature can be mixed and matched by one of ordinary skill in this art to construct a display mountaing system in accordance with principles of the present invention.

Although this invention has been disclosed in the context of certain exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims below.

The invention claimed is:

1. A display panel mounting system for mounting a display panel having a periphery to a mounting surface, comprising:

a first primary releasable attachment element for placement in a first pattern about a periphery of a display panel;

a second primary releasable attachment element for placement on a mounting surface, wherein the second primary releasable attachment element is arranged in a second pattern substantially corresponding to the first pattern;

wherein the first and second primary releasable attachment elements are selectively engaged with each other to define a frame to mount a display panel to a mounting surface; and at least one unitary one-piece supplementary fastening element, different from the first and second primary releasable attachment elements, and having a stiff, substantially non-deformable core resistant to bending and having first and second substantially planar surfaces defining first and second contact areas for respective engagement with a display panel and a mounting surface, and positioned within the first and second patterns of the first and second primary releasable attachment elements;

wherein the at least one supplementary fastening element forms part of a securing element and provides secure supplementary mounting in addition to the first and second primary releasable attachment elements for mounting a display panel to a mounting surface;

wherein the first and second substantially planar surfaces of the at least one supplementary fastening element are provided with a very high bond adhesive;

wherein the adhesive adheres the first and second substantially planar surfaces to a display panel and a mounting surface, respectively; and wherein the at least one supplementary fastening element has a thickness between the first and second substantially planar surfaces in the range of about 1/16 to 3/8 of an inch.

2. The display panel mounting system according to claim 1, wherein the adhesive is a double-sided tape adhesive.

3. The display panel mounting system according to claim 1, wherein the first and second releasable attachment elements are lengths of a substrate having a plurality of periodically spaced interlocking posts, wherein the first and second primary releasable attachment elements are selectively and releasably interlocked with each other to define a frame to mount a display panel to a mounting surface.

4. The display panel mounting system according to claim 1 comprising:

a plurality of supplementary fastening elements, each supplementary fastening element having first and second substantially planar surfaces for respective engagement with a display panel and a mounting surface;

wherein the plurality of supplementary fastening elements is for placement about a periphery of a display panel and adjacent to the first and second primary releasable attachment elements.

5. A method of mounting a display panel having a periphery onto a substrate comprising:

securing a first primary releasable attachment element in a first pattern about a periphery of a display panel;

securing a second primary releasable attachment element on a substrate in a second pattern substantially corresponding to the first pattern;

securing with a very high bond adhesive a first substantially planar surface defining a first contact area of at least one unitary one-piece supplementary fastening element, different from the first and second primary releasable attachment elements, and having a stiff, substantially non-deformable core resistant to bending to a substrate within the first and second patterns of the first and second releasable attachment elements;

engaging the first and second primary releasable attachment elements to define a frame for mounting a display panel to a substrate; and securing with a very high bond adhesive a second substantially planar surface defining a second contact area of the at least one supplementary fastening element to a display panel within the first and second patterns of the first and second releasable attachment elements;

wherein the at least one supplementary fastening element forms part of a securing element and provides secure supplementary mounting in addition to the first and second primary releasable attachment elements for mounting a display panel to a mounting surface; and wherein the at least one supplementary fastening element has a thickness between the first and second substantially planar surfaces in the range of about 1/16 to 3/8 of an inch.

6. The method according to claim 5, further comprising:

securing a plurality of supplementary fastening elements having first and second substantially planar surfaces to a substrate and a display panel, respectively.

7. The method according to claim 6, further comprising:

securing the plurality of supplementary fastening elements about a periphery of a display panel, adjacent to the first and second primary releasable attachment elements.

8. The method according to claim 6, further comprising:

securing a portion of the plurality of supplementary fastening elements about a periphery of a display panel, adjacent to the first and second primary releasable attachment elements; and securing the remaining portion of the plurality of supplementary fastening elements along a middle portion of a display panel within the first and second patterns of the first and second primary releasable attachment elements.

* * * * *